US008172374B2

(12) United States Patent
Sakai et al.

(10) Patent No.: US 8,172,374 B2
(45) **Date of Patent: *May 8, 2012**

(54) LIQUID EJECTING HEAD, LIQUID EJECTING APPARATUS, AND METHOD FOR MANUFACTURING LIQUID EJECTING HEAD

(75) Inventors: Toshifumi Sakai, Shiojiri (JP); Toru Nagate, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 615 days.

This patent is subject to a terminal disclaimer.

(21) Appl. No.: 12/357,140

(22) Filed: Jan. 21, 2009

(65) Prior Publication Data

US 2009/0185005 A1 Jul. 23, 2009

(30) Foreign Application Priority Data

Jan. 22, 2008 (JP) ..... 2008-011214
Sep. 17, 2008 (JP) ..... 2008-237527

(51) Int. Cl.
*B41J 2/045* (2006.01)
*B41J 2/17* (2006.01)

(52) U.S. Cl. ..... 347/70; 347/54; 347/68; 347/71; 347/94

(58) Field of Classification Search ..... 347/68, 347/70, 94
See application file for complete search history.

(56) References Cited

U.S. PATENT DOCUMENTS

| | | | | |
|---|---|---|---|---|
| 6,193,360 | B1 * | 2/2001 | Nishiwaki et al. | 347/70 |
| 7,645,032 | B2 | 1/2010 | Watanabe | |
| 2002/0109744 | A1 | 8/2002 | Shindo | |
| 2005/0040581 | A1 | 2/2005 | Ito | |
| 2008/0079777 | A1 * | 4/2008 | Watanabe | 347/54 |
| 2008/0309735 | A1 | 12/2008 | Watanabe | |

FOREIGN PATENT DOCUMENTS

| | | |
|---|---|---|
| EP | 1 498 268 A1 | 1/2005 |
| EP | 1 504 902 A1 | 2/2005 |
| JP | 2001-105595 | 4/2001 |
| JP | 2005-041047 | 2/2005 |

OTHER PUBLICATIONS

U.S. Appl. No. 12/357,169, Mail Date Sep. 18, 2011, Office Action.

* cited by examiner

*Primary Examiner* — Ryan Lepisto
(74) *Attorney, Agent, or Firm* — Workman Nydegger

(57) ABSTRACT

A liquid ejecting head including a plurality of nozzle orifices for liquid ejection, a reservoir plate made of rolled metal rolled in a first direction which includes a liquid reservoir which extends in a longitudinal direction that is capable of communicating with the plurality of nozzle orifices, and a compliance plate laminated on the reservoir plate which is made of rolled metal rolled in a second direction, the compliance plate including a compliance portion that forms a surface of the liquid reservoir which is also capable of absorbing the pressure in the liquid reservoir. The second direction is parallel to the longitudinal direction of the liquid reservoir and the first direction is perpendicular to the second direction.

12 Claims, 4 Drawing Sheets

LIQUID EJECTING HEAD, LIQUID EJECTING APPARATUS, AND METHOD FOR MANUFACTURING LIQUID EJECTING HEAD

The entire disclosures of Japanese Patent Application Nos. 2008-011214, filed Jan. 22, 2008 and 2008-237527, filed Sep. 17, 2008 are expressly incorporated herein by reference.

BACKGROUND OF THE INVENTION

1. Technical Field

The present invention relates to a liquid ejecting head, a liquid ejecting apparatus, and a method for manufacturing a liquid ejecting head. More specifically, the present invention relates to a pressure chamber forming plate, compliance plate, and nozzle plate for a liquid ejecting head.

2. Related Art

One method currently used for forming a recording head comprises forming a ink jet recording head having a plurality of nozzle orifices capable of discharging ink using a laminating process in order to form a pressure chamber forming plate, a compliance plate, and a nozzle plate. The nozzle plate has a plurality of nozzle orifices arranged in a predetermined configuration. The pressure chamber forming plate forms a plurality of pressure chambers which respectively communicate with the plurality of nozzle orifices. The pressure chamber forming plate has a reservoir which communicates with each pressure chamber via an ink supply passage. The reservoir leads to an opening on the surface of the pressure chamber forming plate on the side of the compliance plate, which is covered by the compliance plate. Ink supplied to the reservoir, from an ink cartridge, for example, is supplied to each pressure chamber through an ink supply passage. Each pressure chamber is provided with a piezoelectric element. When a predetermined drive voltage is applied to one of the piezoelectric elements, the piezoelectric element is deformed (extended), and the pressure chamber is pressurized. As a result, the ink in the pressure chamber is pushed out through the corresponding nozzle orifice and discharged in the form of an ink droplet.

Ink supplied to the recording head, such as ink supplied from an ink cartridge, is temporarily stored in the reservoir before it is supplied to each pressure chamber. At this time, if a large amount of ink is supplied to the reservoir, an excessive pressure may be applied to the reservoir. As a result, ink may be oversupplied to each pressure chamber, and the unnecessary discharge of dots can occur. In order to alleviate this problem, the compliance plate has a recess formed on the side of the nozzle plate, in a portion corresponding to the location of the reservoir. Because of the recess, that portion of the compliance plate is thinner than the rest. Thus, when ink is supplied to the reservoir and the pressure in the reservoir is increased, the thin portion (called compliance portion) is pressed by the ink in the reservoir and bends toward the nozzle plate, thereby absorbing the increased pressure in the reservoir and preventing an erroneous discharge from occurring.

In one ink jet printer head currently known in the art described in Japanese Patent Application No. JP-A-2005-41047, a base plate where the pressure chambers are formed is made from a rolled metal plate where the rolling direction is parallel to the longitudinal direction of the pressure chambers. In another ink jet recording head described in Japanese Patent Application No. JP-A-2005-41047, the nozzle plate is formed from a rolled metal plate where the longitudinal direction of the planar profile is substantially perpendicular to the rolling direction.

Recently, attempts have been made to increase the number of nozzles and to reduce the size of the products. In order to successfully reduce the size of the products, the size of each plate of the recording head needs to be reduced. To reduce the size of each plate, it is necessary to reduce the area of the compliance portion. On the other hand, the amount of ink being supplied to the reservoir is increasing due to the above densification and increase in the number of nozzles. Thus, it is difficult to fully absorb the pressure in the reservoir using a smaller compliance portion, and the risk of the above erroneous discharge is increased.

Each plate of the above recording head is made by rolling metal. Such rolled plates tend to warp in the rolling direction. Such warping of the plates results in the warping of the whole recording head. The warping of the recording head causes, for example, variation in the distance between the nozzles and a recording medium onto which dots are discharged. Thus, warped recording heads are defective products. This is a problem not only for ink jet recording heads that discharge ink but also for various liquid ejecting heads.

BRIEF SUMMARY OF THE INVENTION

An advantage of some aspects of the invention is to provide a liquid ejecting head, a liquid ejecting apparatus, and a method for manufacturing a liquid ejecting head which are capable of preventing various bad effects from occurring due to the increase in pressure generated in the reservoir, such as, for example, erroneous discharges and warping.

A first aspect of the invention comprises a liquid ejecting head including a plurality of nozzle orifices capable of ejecting a liquid, a reservoir plate formed from a rolled metal rolled in a first direction which includes a liquid reservoir which communicates with the plurality of nozzle orifices, and a compliance plate formed from a rolled metal rolled in a second direction which is laminated on the reservoir plate and having a compliance portion which forms a surface of the liquid reservoir, extends in a lengthwise direction, and is capable of absorbing the pressure in the liquid reservoir. The second direction is parallel to the longitudinal direction of the compliance portion of the compliance plate and the first direction is perpendicular to the second direction.

In this aspect of the invention, the compliance plate is rolled in a direction parallel to the longitudinal direction of the compliance portion. Thus, minute lines are formed on the surface of the compliance portion when the metal is rolled. The lines run along the longitudinal direction. As a result, the compliance portion is sufficiently flexible and can effectively absorb the pressure in the liquid reservoir. In addition, since the rolling direction of the compliance plate is perpendicular to the rolling direction of the reservoir plate, the warping of each plate may be prevented, and the whole liquid ejecting head is thereby less likely to include warp defects.

A second aspect of the invention is a liquid ejecting apparatus capable of ejecting liquid from a plurality of nozzle orifices, the apparatus including a liquid ejecting head section. The liquid ejecting head section comprises a reservoir plate made of rolled metal rolled in a first direction, the reservoir plate forming a liquid reservoir which is capable of communicating with the plurality of nozzle orifices and a compliance plate made of rolled metal rolled in a second direction which is disposed on the reservoir plate and having a compliance portion which forms a surface of the liquid reservoir, extends in a lengthwise direction, and is capable of absorbing the pressure in the liquid reservoir. The second direction is parallel to the longitudinal direction of the compliance portion of the compliance plate and the first direction is perpendicular to the second direction.

A third aspect of the invention is a method for manufacturing a liquid ejecting head having a plurality of nozzle orifices capable of ejecting liquid. The method comprises laminating a reservoir plate made of rolled metal rolled in a first direction which includes a liquid reservoir which is capable of communicating with the plurality of nozzle orifices and a compliance plate made of rolled metal rolled in a second direction which includes a compliance portion that forms a surface of the liquid reservoir, the compliance portion extending in a lengthwise direction and being capable of absorbing the pressure in the liquid reservoir. The second direction is parallel to the lengthwise direction of the compliance portion of the compliance plate and the first direction is perpendicular to the second direction.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
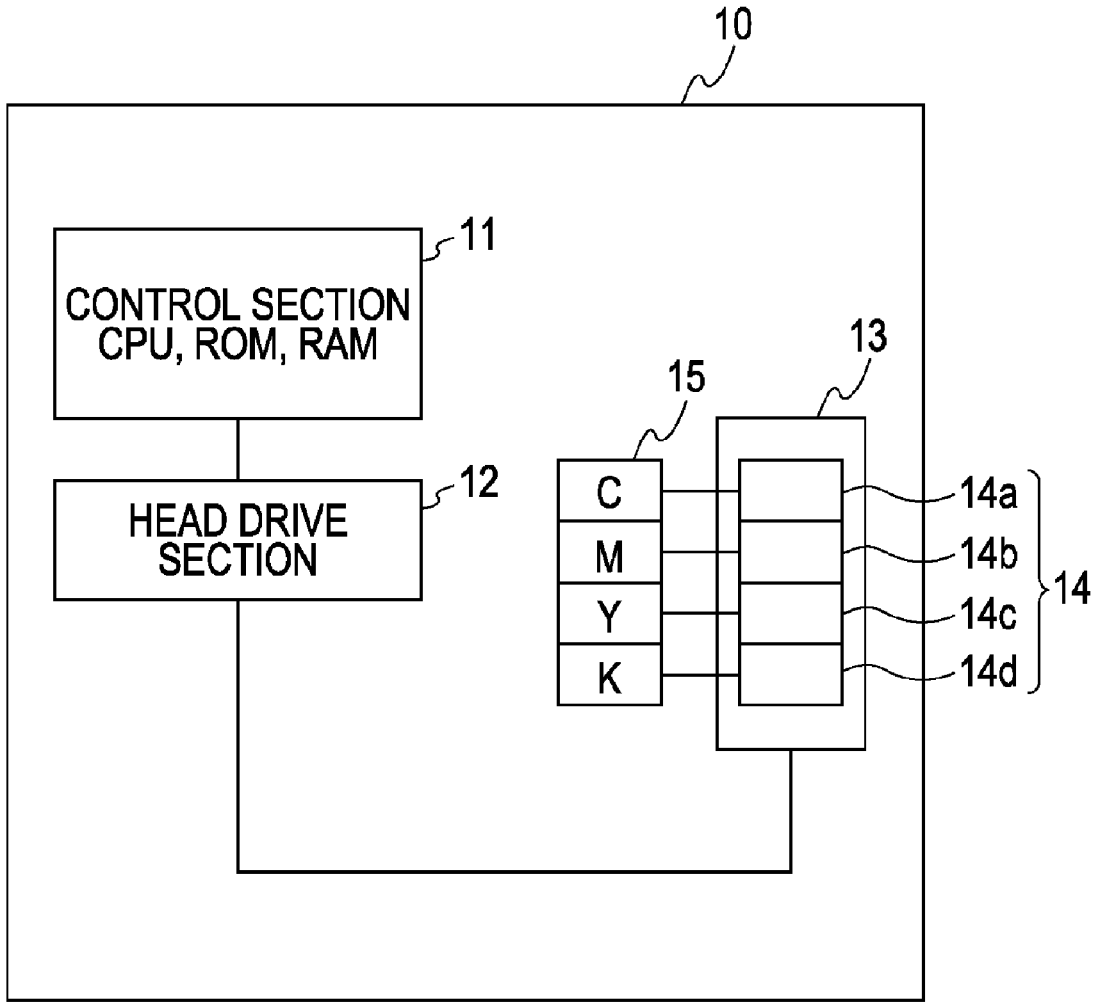
FIG. 1 is a schematic block diagram showing the configuration of an exemplary liquid ejecting apparatus.

The exemplary embodiments of the invention will now be described. In the following description, the terms "parallel" and "perpendicular" are not used in a precise mathematical sense and are merely used to describe the relative configuration of the components. Moreover, the terms "laminate" and "adjacent" are not limited to direct contact, and may include configurations where adhesive or other elements are disposed between the components FIG. 1 is a schematic block diagram showing the configuration of a liquid ejecting apparatus 10 according to an embodiment. In this embodiment, the liquid ejecting apparatus 10 is an ink jet printer, and it includes a control section 11, a head drive section 12, and a recording head unit 13. The control section 11 has a CPU (Central Processing Unit), a ROM (Read Only Memory), a RAM (Random Access Memory), and so forth. In the control section 11, the CPU controls each part according to programs written in the ROM.

The recording head unit 13 is an assembly of recording heads 14 (14*a*, 14*b*, 14*c*, and 14*d*) which each correspond to a color of ink, such as, for example, cyan (C) magenta (M), yellow (Y), and black (B). The number of recording heads 14 constituting the recording head unit 13 and the kinds of inks (liquids) that the recording heads 14 eject are not limited. On the recording head unit 13 are mounted ink cartridges 15 corresponding to the plurality of colors of ink. Each recording head 14 is provided with a plurality of ink jet nozzles (hereinafter simply referred to as nozzles) and piezoelectric elements which together comprise the nozzles. The recording head unit 13 and the recording heads 14 comprise a liquid ejecting head.

The control section 11 generates applied voltage data corresponding to raster data representing an image to be printed and outputs the applied voltage data to the head drive section 12. The applied voltage data define where or not a dot is formed at each pixel. On the basis of the applied voltage data, the head drive section 12 generates a drive voltage to be applied to each piezoelectric element provided in each recording head 14. This generated drive voltage is then supplied to each recording head 14, causing the nozzles of the recording heads 14 discharge drops of liquid. As a result, the drops are formed on a recording medium, and an image corresponding to the above raster data is printed. The liquid ejecting apparatus 10 may have other known components required for a printer, which are not shown in FIG. 1, such as a carriage mechanism, a paper feed mechanism, and a communication interface. The carriage mechanism reciprocates a carriage on which the recording head unit 13 is mounted along a guide rail. The paper feed mechanism transports a recording medium in a paper-feed direction, which is perpendicular to the reciprocating direction of the carriage, herein referred to as the main scanning direction. The recording medium is transported at a predetermined speed by driving a series of paper feed rollers. The communication interface receives the above raster data transmitted from a printer driver, such as, for example, an external PC.

Figure 2:
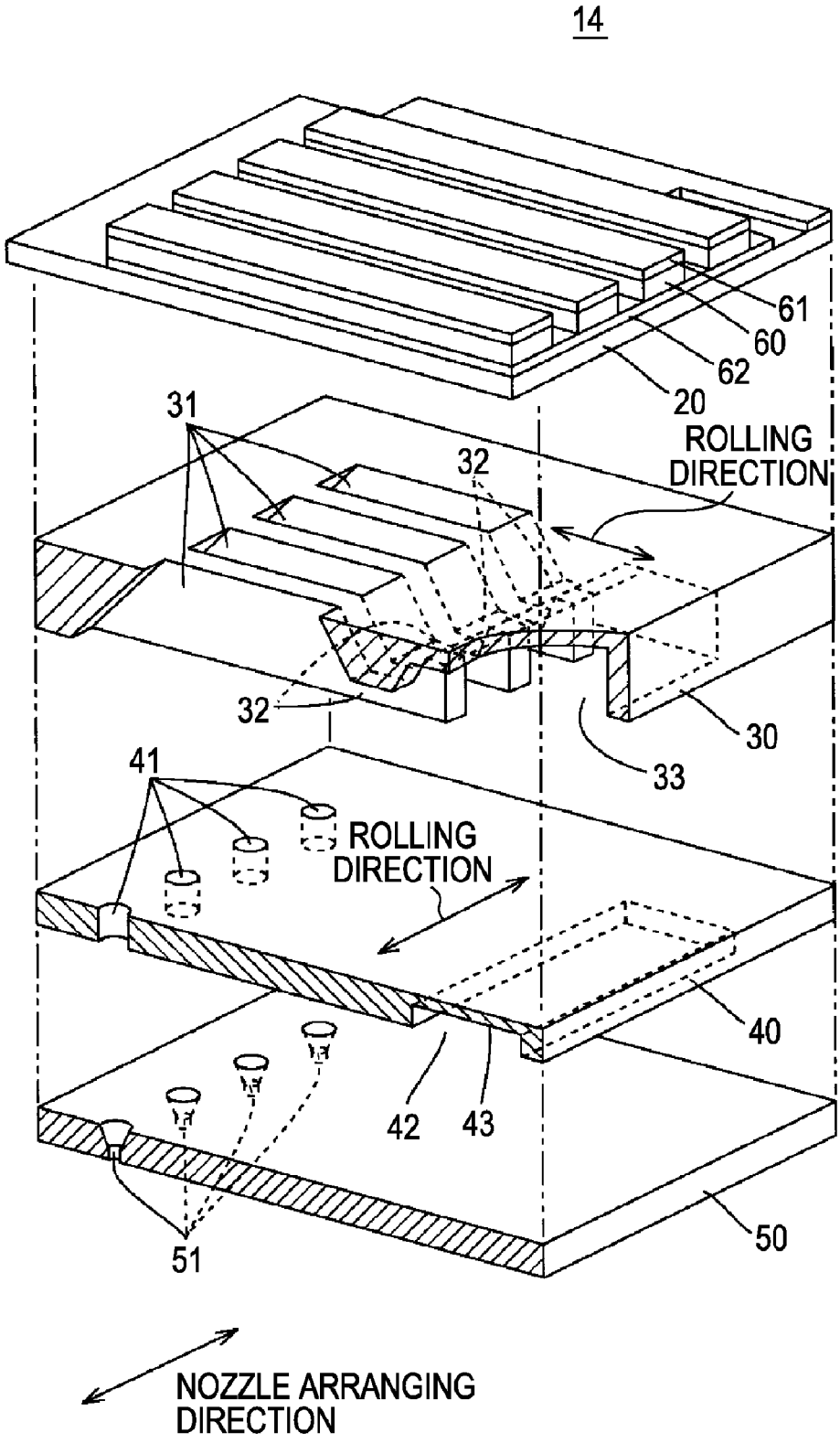
FIG. 2 is an exploded perspective view of a part of a recording head.
Figure 3:
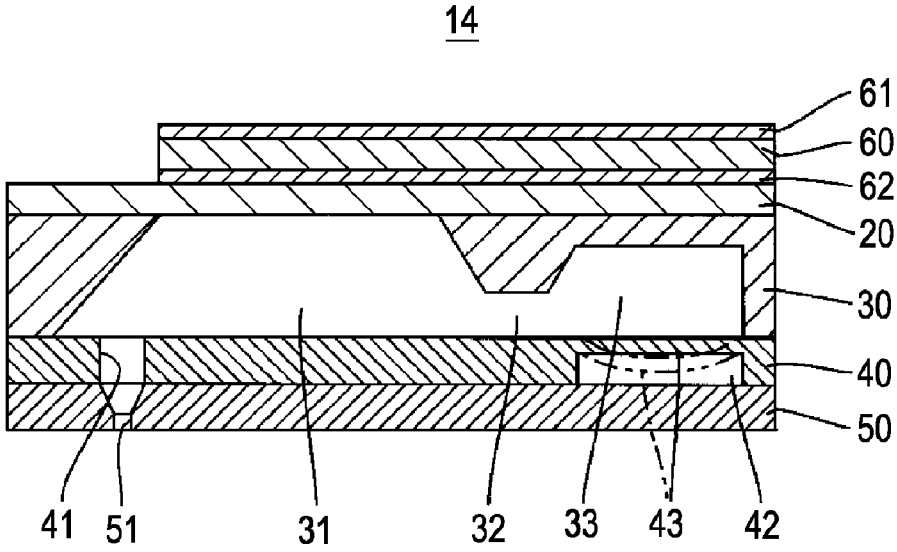
FIG. 3 is a sectional view of a part of a recording head.

FIG. 2 is an exploded perspective view showing a portion of one of the recording heads 14. FIG. 3 is a sectional view showing a part of the recording head 14. The following description is of a method for manufacturing a recording head as well as of a recording head. The recording head 14 is formed by bonding a plurality of plate-like members with adhesive and laminating them. The plurality of plate-like members are, in order, starting from the top, an elastic plate 20, a pressure chamber forming plate 30, a compliance plate 40, and a nozzle plate 50. The nozzle plate 50 comprises the lower surface of the recording head 14, and includes a plurality of nozzle orifices 51 which are arranged at a predetermined pitch in a predetermined direction, thereby forming a nozzle array corresponding to a color of ink. The direction in which the nozzle orifices 51 are arranged, herein referred to as a nozzle arranging direction, is substantially perpendicular to the main scanning direction. The nozzle plate 50 comprises a plate which is adjacent to the compliance plate. The compliance plate 40 has a plurality of communication ports 41 formed at positions corresponding to the plurality of nozzle orifices 51 and a recess 42, which has a substantially rectangular vertical section and opens toward the nozzle plate 50.

The pressure chamber forming plate 30 forms a plurality of pressure chambers 31 at positions corresponding to the plurality of communication ports 41. Each pressure chamber 31 forms a space that extends to both the upper and lower surfaces of the pressure chamber forming plate 30. The pressure chambers 31 are arranged at a predetermined pitch in the nozzle arranging direction. The pressure chamber forming plate 30 has a reservoir 33 formed therein. The reservoir 33 communicates with each pressure chamber 31 via an ink supply passage 32 corresponding to each pressure chamber 31. The ink supply passages 32 and reservoir 33 are recesses that open toward the compliance plate 40. The length of the reservoir 33 is parallel to the nozzle arranging direction, while the width thereof is perpendicular to the nozzle arranging direction.

The ink supply passages 32 are parallel to the width of the reservoir 33 and connect the reservoir 33 to the pressure chambers 31. Each pressure chamber 31 is covered by the compliance plate 40 except for the portions comprising the communication ports 41. The ink supply passages 32 and the reservoir 33 are covered by the compliance plate 40. In terms of forming the reservoir 33, the pressure chamber forming plate 30 comprises a kind of reservoir plate.

The upper openings of the pressure chambers 31 are covered by the elastic plate 20. On the upper side of the elastic plate 20, a plurality of piezoelectric elements 60 are provided at predetermined positions which correspond to the pressure chambers 31. On the top of each piezoelectric element 60 is an electrode 61. Underneath the piezoelectric elements 60 is an electrode 62. So, each piezoelectric element 60 is disposed between the electrodes 61 and 62. In this configuration, ink is supplied to the reservoir 33 from the above ink cartridge 15 via a supply passage (not shown). As a result, ink is supplied to each pressure chamber 31. The previously described drive voltage is applied to the electrodes 61 and 62 of each piezoelectric element 60 in order to deform each piezoelectric element 60. The pressure chambers 31 corresponding to the deformed piezoelectric elements 60 are also deformed, and dots are discharged downward from the corresponding nozzle orifice 51.

A recess 42 is formed under the reservoir 33, in a portion substantially corresponding to the area (horizontal sectional area) of the reservoir 33. Thus, the length and width of a thin portion, referred to as the compliance portion 43 of the compliance plate 40, has substantially the same shape as the reservoir 33, separates the reservoir 33 from the recess 42, and covers the reservoir 33. The length and width of the recess 42 also correspond to the shape of the reservoir 33. When the pressure in the reservoir 33 is increased by the supply of ink to the reservoir 33, the compliance portion 43 bends so as to expand toward the nozzle plate 50, as shown by the dotted line in FIG. 3, thereby absorbing the pressure in the reservoir 33.

In this embodiment, the pressure chamber forming plate 30, the compliance plate 40, and the nozzle plate 50 are formed of a metal plate made by rolling metal. The above various recesses and through-holes are formed, for example, by etching. When metal is rolled in a direction, rolling marks are formed on the surface of the resulting metal plate along the rolling direction. The rolling marks appear as minute lines, which extend along the rolling direction. When a cross-section of the metal plate is viewed in a direction perpendicular to the rolling direction, minute notches are formed on the rolled surface. The lines formed on the surface of the metal plate function as beams, making it difficult to bend the rolled metal plate in the rolling direction but easy to bend in a direction perpendicular to the rolling direction.

In this embodiment, as shown in FIG. 2, the rolling direction of the compliance plate 40 is substantially parallel to the length of the recess 42 and the compliance portion 43. In other words, when the compliance plate 40 is made of a metal plate, the recess 42 and the communication ports 41 are formed so to have a length which is substantially parallel to the rolling direction of the metal plate. As a result, the above lines run on the surface of the compliance plate 40 and compliance portion 43 along the length of the recess 42.

Figure 4:
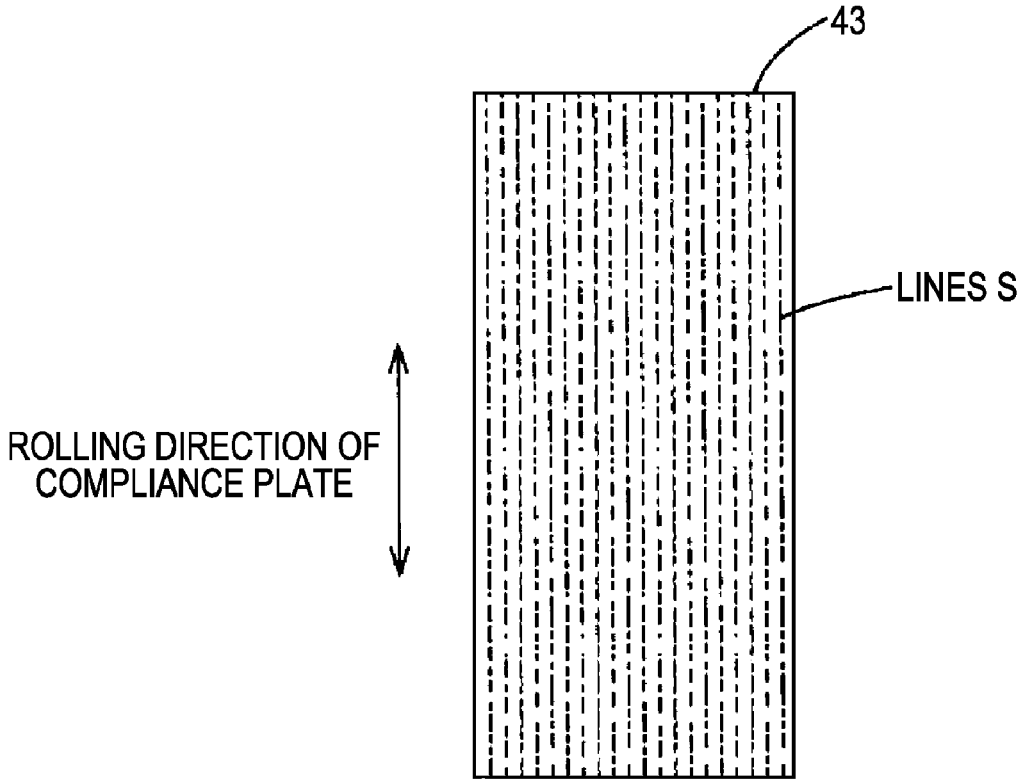
FIG. 4 shows the surface of the compliance portion.

FIG. 4 illustrates the surface of the compliance portion 43. The figure shows a substantially rectangular portion of the compliance plate 40 comprising the compliance portion 43. Many lines S are formed on the surface of the compliance portion 43 along the length of the compliance portion 43. In many cases, the lines S are actually too minute for the naked eye to see.

In this embodiment, as shown in FIG. 2, the rolling direction of the pressure chamber forming plate 30 is substantially perpendicular to the rolling direction of the compliance plate 40. In other words, when the pressure chamber forming plate 30 is made of a metal plate, the reservoir 33 is formed with a length that is substantially perpendicular to the rolling direction of the metal plate. As a result, the previously described lines run on the surface of the pressure chamber forming plate 30 in a direction that is substantially perpendicular to the length of the reservoir 33.

As described above, according to this embodiment, the compliance portion 43 has a plurality of lines (beams) formed along the length of the recess 42. So, the compliance portion 43 can very easily bend in the direction of the width of the recess 42. As for the longitudinal direction of the recess 42, bending is prevented to some extent by the beams. However, since the beams on the compliance portion 43 are large in length (the beams on the compliance portion 43 are larger in length than they are when they run in the width direction of the recess 42), the degree to which bending is prevented is small. As a result, the whole compliance portion 43 has increased flexibility. So, if the amount of ink supplied to the reservoir 33 is increased and the compliance portion 43 is reduced in size due to the densification of the nozzles and the downsizing of the recording head 14, the pressure in the reservoir 33 can be adequately absorbed by the bending of the compliance portion 43, and bad effects of the increase in pressure in the reservoir 33, such as the erroneous discharge of dots, can be prevented.

In addition, the rolling directions of the compliance plate 40 and the pressure chamber forming plate 30, which are in contact with each other, are substantially perpendicular. So, the compliance plate 40 and the pressure chamber forming plate 30 prevent each other's warping, meaning that the whole recording head 14 is unlikely to warp. As a result, variation between the nozzle orifices 51 in the distance to a recording medium caused by the warping of the recording head 14 decreases, and a high-quality product can be provided.

Configurations where the rolling directions of other components are defined may also be used. For example, the rolling direction of the nozzle plate 50 may also be limited. In this case, the rolling direction of the nozzle plate 50 is preferably substantially perpendicular to the nozzle arranging direction. In other words, when the nozzle plate 50 is made of a metal plate, the rolling direction of the nozzle plate is preferably substantially perpendicular to the nozzle arranging direction of the nozzle plate 50. As a result, the rolling directions of the pressure chamber forming plate 30 and the nozzle plate 50 are substantially the same, with the compliance plate 40 being disposed between the two components. Using this configuration, the warping of the compliance plate 40 may be prevented, except where the compliance portion 43 is formed. Thus, the warping of the recording head 14 may be prevented.

Figure 5:
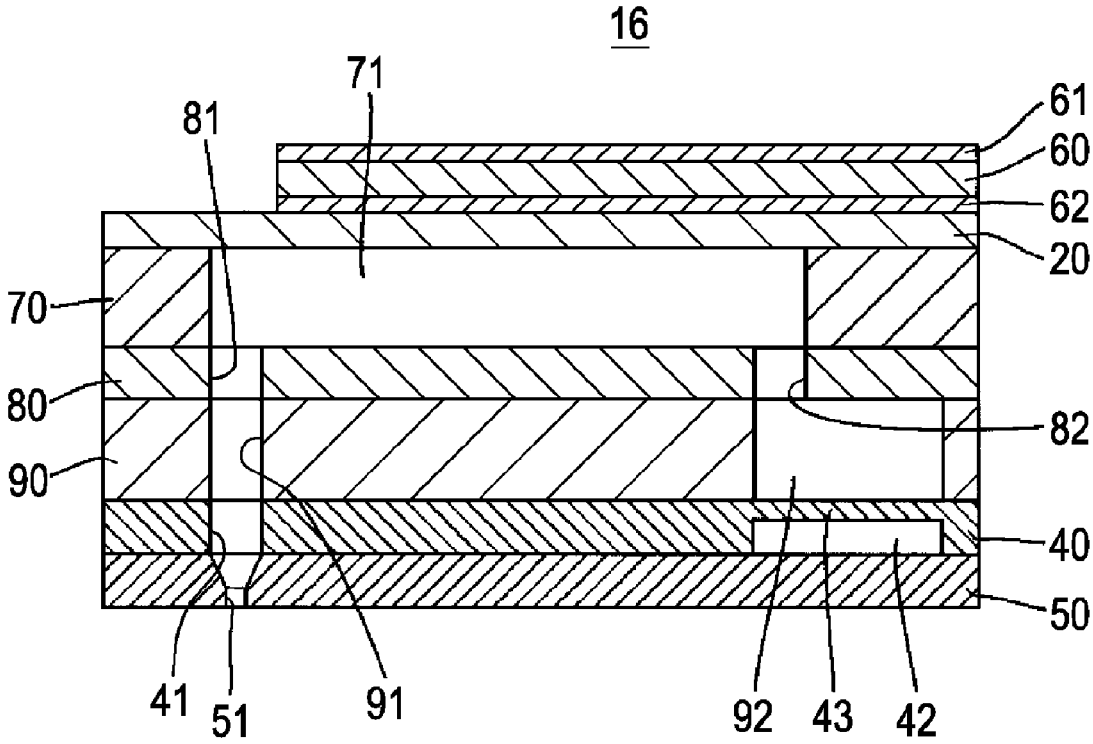
FIG. 5 is a sectional view of a part of a recording head.

FIG. 5 is a sectional view of a part of a recording head 16 according to another embodiment. The liquid ejecting apparatus 10 may have recording head 16 instead of recording head 14. In FIG. 5, the same reference numerals will be used to designate the same components as those of the recording head 14 shown in FIG. 3. The recording head 16 includes a pressure chamber forming plate 70, a supply passage forming plate 80, and a reservoir plate 90 laminated between the elastic plate 20 and the compliance plate 40. The pressure chamber forming plate 70, the supply passage forming plate 80, and the reservoir plate 90 are also plate-like members made by rolling metal.

The reservoir plate 90 has communication ports 91 formed at positions corresponding to the communication ports 41 of the compliance plate 40, and a reservoir 92 formed in a portion corresponding to the recess 42. The reservoir 92 is a space formed through the reservoir plate 90. The supply passage forming plate 80 disposed on the top of the reservoir plate 90 covers the reservoir 92 while forming ink supply passages 82 which correspond to the reservoir 92. In addition, the supply passage forming plate 80 has communication ports 81 formed at positions corresponding to the communication ports 91. The pressure chamber forming plate 70 on the top of the supply passage forming plate 80 forms pressure chambers 71, each of which communicate with the corresponding ink supply passage 82 and communication port 81.

A plurality of pressure chambers 71 are arranged at a predetermined pitch in the nozzle arranging direction of the recording head 16, as described above with reference to recording head 14. The length of the reservoir 92 is parallel to the nozzle arranging direction. The reservoir 92 supplies ink to each pressure chamber 71 via an ink supply passage 82. In the recording head 16, the rolling directions of the compliance plate 40 and the supply passage forming plate 80 are substantially parallel. Since the rolling direction of the compliance plate 40 is substantially parallel to the length of the recess 42 and reservoir 92, the rolling direction of the supply passage forming plate 80 is also parallel to the length of the recess 42. The supply passage forming plate 80 comprises a plate which is adjacent to the reservoir plate in the invention. Of course, the rolling direction of the reservoir plate 90 is substantially perpendicular to the rolling directions of the compliance plate 40 and the supply passage forming plate 80.

Using this configuration, the flexibility of the compliance portion 43 is increased, the warping of the recording head 16 may be prevented, and in addition, the flow resistance of ink in the reservoir 92 may be reduced. Since rolling marks (lines) are formed parallel to the length of the reservoir 92 on the surfaces of the supply passage forming plate 80 and the compliance plate 40 that cover the upper and lower openings of the reservoir 92, ink flows along such lines in the reservoir 92. As a result, ink is evenly supplied to the plurality of pressure chambers 71 arranged in the longitudinal direction of the reservoir 92. In addition, the rolling directions of the pressure chamber forming plate 70 and the nozzle plate 50 can also be limited in the recording head 16. In this case, the rolling directions of the laminated plates from the pressure chamber forming plate 70 to the nozzle plate 50 are determined such that the rolling directions of any two adjacent plates are perpendicular. Such a configuration strongly prevents the warping of the recording head 16.

In the above embodiments, the compliance plate 40 forms the compliance portion 43 by forming the recess 42 which corresponds to the reservoir in the opposite surface from the surface of the compliance plate 40 which faces the reservoir. However, the compliance portion 43 only has to be able to absorb the pressure generated in the reservoir. For example, it is possible to reduce the thickness of the whole compliance plate 40 without forming the recess 42 and to thereby form the compliance portion 43 at a position corresponding to the reservoir.

In the above embodiments, the liquid ejecting heads and liquid ejecting apparatuses eject ink onto a recording medium in order to perform a printing process. However, the configuration of the invention can be applied to any apparatus that ejects liquid onto an object, such as a color material ejecting apparatus used for manufacturing a color filter, or an organic matter ejecting apparatus used for manufacturing biochips. Although, in the above embodiments, the liquid ejecting heads discharge liquid using piezoelectric elements 60, various other pressure generators, such as heater elements, may also be used.

What is claimed is:

1. A liquid ejecting head comprising:

a plurality of nozzle orifices capable of ejecting a liquid;

a reservoir plate formed from a rolled metal rolled in a first direction which includes a liquid reservoir which communicates with the plurality of nozzle orifices; and a compliance plate formed from a rolled metal rolled in a second direction which is laminated on the reservoir plate and having a compliance portion which forms a surface of the liquid reservoir, extends in a lengthwise direction, and is capable of absorbing the pressure in the liquid reservoir, a reservoir adjacent plate made of rolled metal which is rolled in the second direction, the reservoir adjacent plate being laminated so as to cover an opposite side of the liquid reservoir from a side of the liquid reservoir where the compliance plate is laminated;

wherein the compliance plate and the reservoir adjacent plate are configured to evenly supply the liquid to a plurality of pressure chambers arranged in a longitudinal direction of the liquid reservoir, wherein the second direction is parallel to the longitudinal direction of the compliance portion of the compliance plate, and the first direction is perpendicular to the second direction.

2. The liquid ejecting head according to claim 1, wherein the liquid reservoir is formed through the reservoir plate.

3. The liquid ejecting head according to claim 1, further comprising a compliance adjacent plate made of rolled metal which is rolled in the first direction, the compliance adjacent plate being laminated on an opposite side of the compliance plate from a side where the compliance plate is laminated on the reservoir plate.

4. The liquid ejecting head according to claim 1, wherein the compliance portion flexes in order to expand a volume of the liquid reservoir in order to absorb the pressure in the liquid reservoir.

5. A liquid ejecting apparatus capable of ejecting liquid from a plurality of nozzle orifices, the apparatus including a liquid ejecting head section comprising:

a reservoir plate made of rolled metal rolled in a first direction, the reservoir plate forming a liquid reservoir which is capable of communicating with the plurality of nozzle orifices; and a compliance plate made of rolled metal rolled in a second direction which is disposed on the reservoir plate and having a compliance portion which forms a surface of the liquid reservoir, extends in a lengthwise direction, and is capable of absorbing the pressure in the liquid reservoir, a reservoir adjacent plate made of rolled metal which is rolled in the second direction, the reservoir adjacent plate being laminated so as to cover an opposite side of the liquid reservoir from a side of the liquid reservoir where the compliance plate is laminated;

wherein the compliance plate and the reservoir adjacent plate are configured to evenly supply the liquid to a plurality of pressure chambers arranged in a longitudinal direction of the liquid reservoir, wherein second direction is parallel to the longitudinal direction of the compliance portion of the compliance plate and the first direction is perpendicular to the second direction.

6. The liquid ejecting apparatus according to claim 5, wherein the liquid reservoir is formed through the reservoir plate.

7. The liquid ejecting apparatus according to claim 5, further comprising a compliance adjacent plate made of rolled metal which is rolled in the first direction, the compliance adjacent plate being laminated on an opposite side of the compliance plate from a side where the compliance plate is laminated on the reservoir plate.

8. The liquid ejecting apparatus according to claim 5, wherein the compliance portion flexes in order to expand a volume of the liquid reservoir in order to absorb the pressure in the liquid reservoir.

9. A method for manufacturing a liquid ejecting head having a plurality of nozzle orifices capable of ejecting liquid, the method comprising:

laminating a reservoir plate made of rolled metal rolled in a first direction which includes a liquid reservoir which is capable of communicating with the plurality of nozzle orifices; and laminating a compliance plate made of rolled metal rolled in a second direction which includes a compliance portion that forms a surface of the liquid reservoir, the compliance portion extending in a lengthwise direction and being capable of absorbing pressure in the liquid reservoir; and laminating a reservoir adjacent plate made of rolled metal which is rolled in the second direction, the reservoir adjacent plate being laminated so as to cover an opposite side of the liquid reservoir from a side of the liquid reservoir where the compliance plate is laminated;

wherein the compliance plate and the reservoir adjacent plate are configured to evenly supply the liquid to a plurality of pressure chambers arranged in a longitudinal direction of the liquid reservoir, wherein the second direction is parallel to the lengthwise direction of the compliance portion of the compliance plate and the first direction is perpendicular to the second direction.

10. The method according to claim 9, wherein the liquid reservoir is formed through the reservoir plate.

11. The method according to claim 9, further comprising laminating a compliance adjacent plate made of rolled metal which is rolled in the first direction so as to cover an opposite side of the compliance plate from a side where the compliance plate is laminated on the reservoir plate.

12. The method according to claim 9, wherein the compliance portion is capable of flexing in order to expand a volume of the liquid reservoir in order to absorb the pressure in the liquid reservoir.

* * * * *